US010280773B2

(12) United States Patent
Burdgick et al.

(10) Patent No.: US 10,280,773 B2
(45) Date of Patent: May 7, 2019

(54) TURBOMACHINE ALIGNMENT KEY AND RELATED TURBOMACHINE

(71) Applicant: General Electric Company, Schenectady, NY (US)

(72) Inventors: Steven Sebastian Burdgick, Schenectady, NY (US); Jesus Mendoza, Queretaro (MX); Salvador Lopez Mata, Queretaro (MX)

(73) Assignee: General Electric Company, Schenectady, NY (US)

( * ) Notice: Subject to any disclaimer, the term of this patent is extended or adjusted under 35 U.S.C. 154(b) by 502 days.

(21) Appl. No.: 15/092,106

(22) Filed: Apr. 6, 2016

(65) Prior Publication Data

US 2017/0292390 A1 Oct. 12, 2017

(51) Int. Cl.
*F01D 9/04* (2006.01)
*F01D 25/24* (2006.01)

(52) U.S. Cl.
CPC ..... *F01D 9/041* (2013.01); *F01D 9/042* (2013.01); *F01D 25/246* (2013.01); *F05D 2230/64* (2013.01)

(58) Field of Classification Search
CPC . F01D 25/246; F01D 9/00; F01D 9/02; F01D 9/04; F01D 9/041; F16B 19/02
USPC ..... 411/351
See application file for complete search history.

(56) References Cited

U.S. PATENT DOCUMENTS 3,373,648 A 3/1968 Pitzer
3,498,727 A * 3/1970 Bollinger, Jr. ..... B60T 8/3235 415/136
5,271,714 A 12/1993 Shepherd et al.
9,028,210 B2 5/2015 Sankolli et al.
2008/0286097 A1* 11/2008 Chevrette ..... F01D 25/246 415/209.2
2013/0078086 A1 3/2013 Breugnot et al.
(Continued)

FOREIGN PATENT DOCUMENTS

EP 2 740 902 A2 6/2014
FR 2 960 591 A1 12/2011
GB 2 309 053 A 7/1997

OTHER PUBLICATIONS

Partial European Search Report and Opinion issued in connection with corresponding EP Application No. 17164376.0 dated Sep. 6, 2017.

*Primary Examiner* — Christopher Verdier
*Assistant Examiner* — Cameron A Corday
(74) *Attorney, Agent, or Firm* — Ernest G. Cusick; Hoffman Warnick LLC

(57) ABSTRACT

Various aspects include an alignment key for a turbomachine, along with a turbomachine including the alignment key and a related storage medium. In some cases, the alignment key includes: a body having primary axis and sized to engage a diaphragm slot in the turbomachine, the body having sidewalls extending along the primary axis; a chamfered tip section continuous with the body, the chamfered tip section sized to engage a casing slot in the turbomachine; and a slot extending through the body and the chamfered tip section, the slot having a first opening proximate an end of the body and a second opening proximate the chamfered tip section, wherein the sidewalls of the body taper from the end of the body toward the chamfered tip section.

19 Claims, 8 Drawing Sheets

(56) References Cited

U.S. PATENT DOCUMENTS

| | | | |
|---|---|---|---|
| 2014/0037442 | A1 | 2/2014 | Tatman et al. |
| 2017/0292391 | A1 | 10/2017 | Burdgick et al. |

* cited by examiner

TURBOMACHINE ALIGNMENT KEY AND RELATED TURBOMACHINE

BACKGROUND OF THE INVENTION

The subject matter disclosed herein relates to steam turbines. Specifically, the subject matter disclosed herein relates to alignment of steam turbines.

Steam turbines include static nozzle assemblies that direct flow of a working fluid into turbine buckets connected to a rotating rotor. The nozzle construction (including a plurality of nozzles, or "airfoils") is sometimes referred to as a "diaphragm" or "nozzle assembly stage." Steam turbine diaphragms include two halves, which are assembled around the rotor, creating horizontal joints between these two halves. Each turbine diaphragm stage is vertically supported by support bars, support lugs or support screws on each side of the diaphragm at the respective horizontal joints. The horizontal joints of the diaphragm also correspond to horizontal joints of the turbine casing, which surrounds the steam turbine diaphragm. Diaphragm centering (or, alignment) pins (or keys) are used to position the diaphragms in the transverse direction during installation. These centering pins are also designed to take the torque load generated by the diaphragm.

The centering pin is traditionally installed in an area of the diaphragm assembly with a small interference. The centering pin is traditionally cooled (e.g., frozen) to a point in which it contracts to fit in this area of small clearance. This often requires the use of dry ice or another severe cooling mechanism during installation, e.g., in the field. However, the unavailability and relatively high cost of these severe cooling mechanisms can be undesirable. Additionally, freezing and thawing of the centering pin can cause misalignment of the turbine diaphragm. Other pins are bolted into place, which causes other concerns. Boiling still allows for movement of the pin under loading in one direction. Further, having a small bolt hole in the turbine casing is undesirable due to stress concentration proximate the hole.

BRIEF DESCRIPTION OF THE INVENTION

Various aspects include an alignment key for a turbomachine, along with a turbomachine including the alignment key and a related storage medium. In some cases, the alignment key includes: a body having primary axis and sized to engage a diaphragm slot in the turbomachine, the body having sidewalls extending along the primary axis; a chamfered tip section continuous with the body, the chamfered tip section sized to engage a casing slot in the turbomachine; and a slot extending through the body and the chamfered tip section, the slot having a first opening proximate an end of the body and a second opening proximate the chamfered tip section, wherein the sidewalls of the body taper from the end of the body toward the chamfered tip section.

A first aspect of the disclosure includes an alignment key having: a body having primary axis and sized to engage a diaphragm slot in the turbomachine, the body having sidewalls extending along the primary axis; a chamfered tip section continuous with the body, the chamfered tip section sized to engage a casing slot in the turbomachine; and a slot extending through the body and the chamfered tip section, the slot having a first opening proximate an end of the body and a second opening proximate the chamfered tip section, wherein the sidewalls of the body taper from the end of the body toward the chamfered tip section.

A second aspect of the disclosure includes a turbomachine having: a turbine diaphragm segment; a turbine casing segment at least partially housing the turbine diaphragm segment; and an alignment key for aligning the turbine diaphragm segment with the turbine casing segment, the alignment key including: a body having primary axis and sized to engage a diaphragm slot in the turbomachine, the body having sidewalls extending along the primary axis; a chamfered tip section continuous with the body, the chamfered tip section sized to engage a casing slot in the turbomachine; and a slot extending through the body and the chamfered tip section, the slot having a first opening proximate an end of the body and a second opening proximate the chamfered tip section, wherein the sidewalls of the body taper from the end of the body toward the chamfered tip section.

A third aspect of the disclosure includes a non-transitory computer readable storage medium storing code representative of an alignment key for a turbomachine, the alignment key physically generated upon execution of the code by a computerized additive manufacturing system, the code having: code representing the alignment key nozzle, the alignment key including: a body having primary axis and sized to engage a diaphragm slot in the turbomachine, the body having sidewalls extending along the primary axis; a chamfered tip section continuous with the body, the chamfered tip section sized to engage a casing slot in the turbomachine; and a slot extending through the body and the chamfered tip section, the slot having a first opening proximate an end of the body and a second opening proximate the chamfered tip section, wherein the sidewalls of the body taper from the end of the body toward the chamfered tip section.

BRIEF DESCRIPTION OF THE DRAWINGS

These and other features of this invention will be more readily understood from the following detailed description of the various aspects of the invention taken in conjunction with the accompanying drawings that depict various embodiments of the disclosure, in which.

Figure 1:
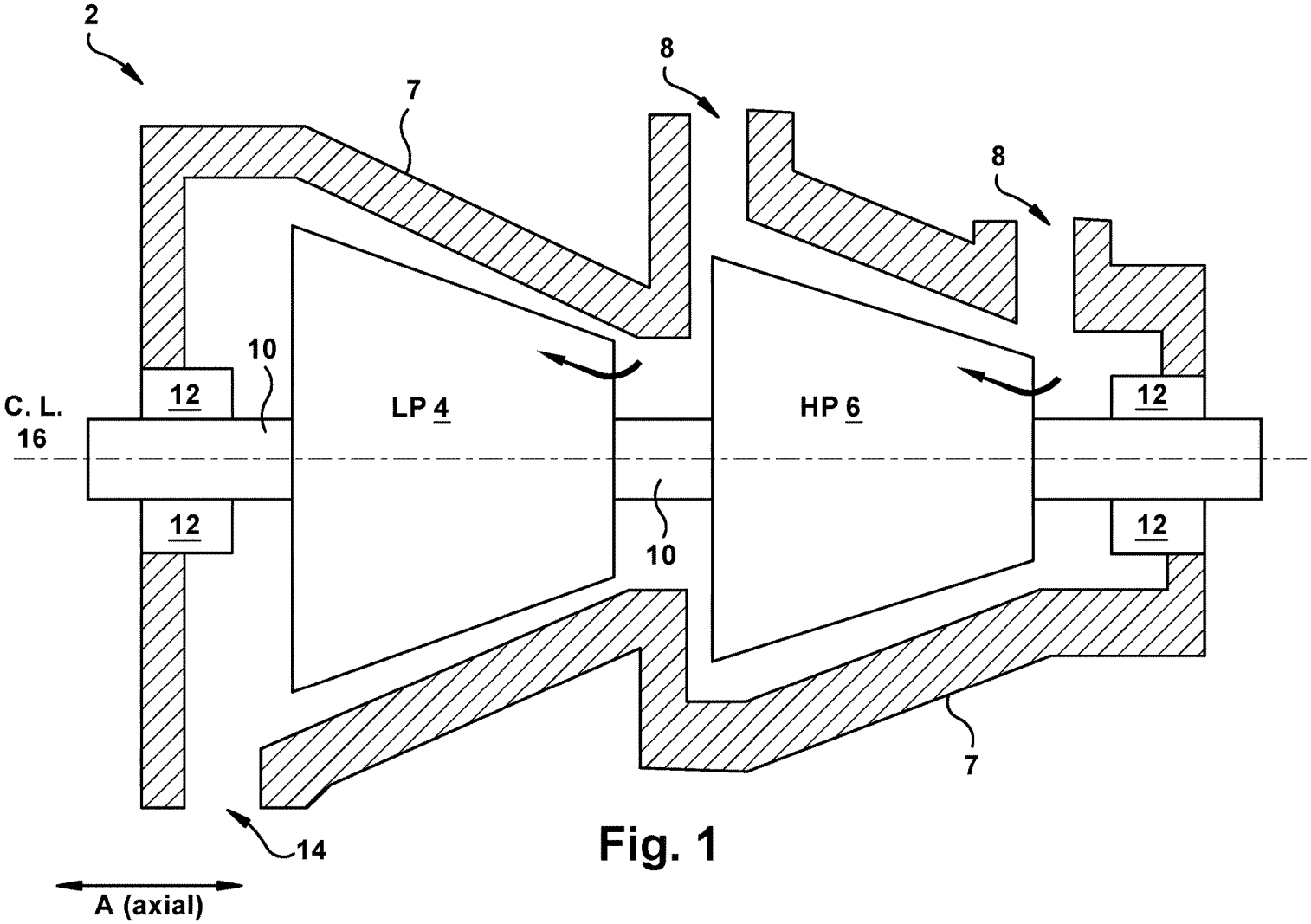
FIG. 1 shows a partial cross-sectional schematic view of a turbomachine according to various embodiments.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

The subject matter disclosed herein relates to turbomachines. Specifically, the subject matter disclosed herein relates to alignment of turbomachines, e.g., steam turbines.

In the conventional scenario, the centering pin is installed with a small degree (e.g., 0.0005-0.002 inches, or 0.0127-0.0508 millimeters) interference fit in a casing slot. In order to meet this small level of interference, the centering pin is cooled (e.g., until frozen) to a temperature below zero degrees Fahrenheit (F), e.g., as cold as −140 degrees F. (approximately −95 degrees Celsius), or in the case of liquid nitrogen cooling, up to −320 degrees F. (approximately −195 degrees Celsius) cooling. As noted herein, it may be difficult to cool the centering pin to such a temperature, in particular, while the centering pin is installed on location. Additionally, freezing and thawing of the centering pin can cause misalignment of the turbine diaphragm.

According to various embodiments of the disclosure, in contrast to conventional approaches, a turbomachine alignment key including a tapered body, where the alignment key is sized to engage a diaphragm slot and corresponding casing slot to align the diaphragm of a turbomachine with its casing. In various embodiments, the alignment key includes a chamfered tip section that is continuous with the body, where the outer surfaces of the chamfered tip section are angled at a distinct angle with respect to a reference line than the tapered body. Embodiments of the turbomachine alignment key disclosed are configured to align a diaphragm and casing without requiring the cooling (e.g., freeze-fit) used in conventional approaches. The various features of the alignment keys disclosed allow for more effective and efficient alignment of turbomachines.

As denoted in these Figures, the "A" axis represents axial orientation (along the axis of the turbine rotor, sometimes referred to as the turbine centerline). As used herein, the terms "axial" and/or "axially" refer to the relative position/direction of objects along axis A, which is substantially parallel with the axis of rotation of the turbomachine (in particular, the rotor section). As further used herein, the terms "radial" and/or "radially" refer to the relative position/direction of objects along axis (r), which is substantially perpendicular with axis A and intersects axis A at only one location. Additionally, the terms "circumferential" and/or "circumferentially" refer to the relative position/direction of objects along a circumference (c) which surrounds axis A but does not intersect the axis A at any location. Identically labeled elements in the Figures depict substantially similar (e.g., identical) components.

Turning to FIG. 1, a partial cross-sectional schematic view of steam turbine 2 (e.g., a high-pressure/intermediate-pressure steam turbine) is shown. Steam turbine 2 may include, for example, a low pressure (LP) section 4 and a high pressure (HP) section 6 (it is understood that either LP section 4 or HP section 6 can include an intermediate pressure (IP) section, as is known in the art). The LP section 4 and HP section 6 are at least partially encased in casing 7. Steam may enter the HP section 6 and LP section 4 via one or more inlets 8 in casing 7, and flow axially downstream from the inlet(s) 8. In some embodiments, HP section 6 and LP section 4 are joined by a common shaft 10, which may contact bearings 12, allowing for rotation of the shaft 10, as working fluid (steam) forces rotation of the blades within each of LP section 4 and HP section 6. After performing mechanical work on the blades within LP section 4 and HP section 6, working fluid (e.g., steam) may exit through outlet 14 in casing 7. The center line (CL) 16 of HP section 6 and LP section 4 is shown as a reference point. Both LP section 4 and HP section 6 can include diaphragm assemblies, which are contained within segments of casing 7.

Figure 2:
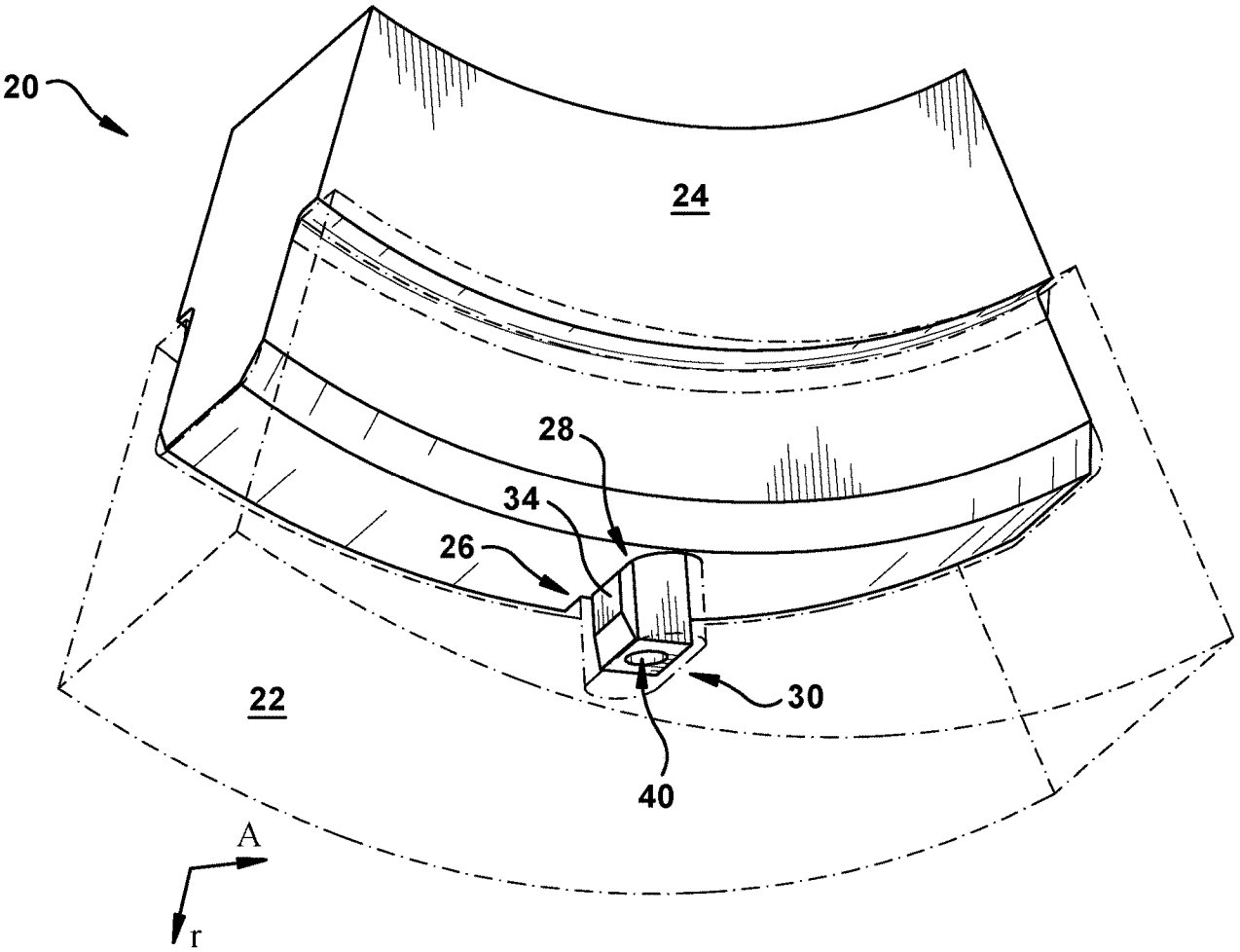
FIG. 2 shows a partially transparent three-dimensional schematic depiction of a portion of a turbomachine according to various embodiments of the disclosure.
Figure 3:
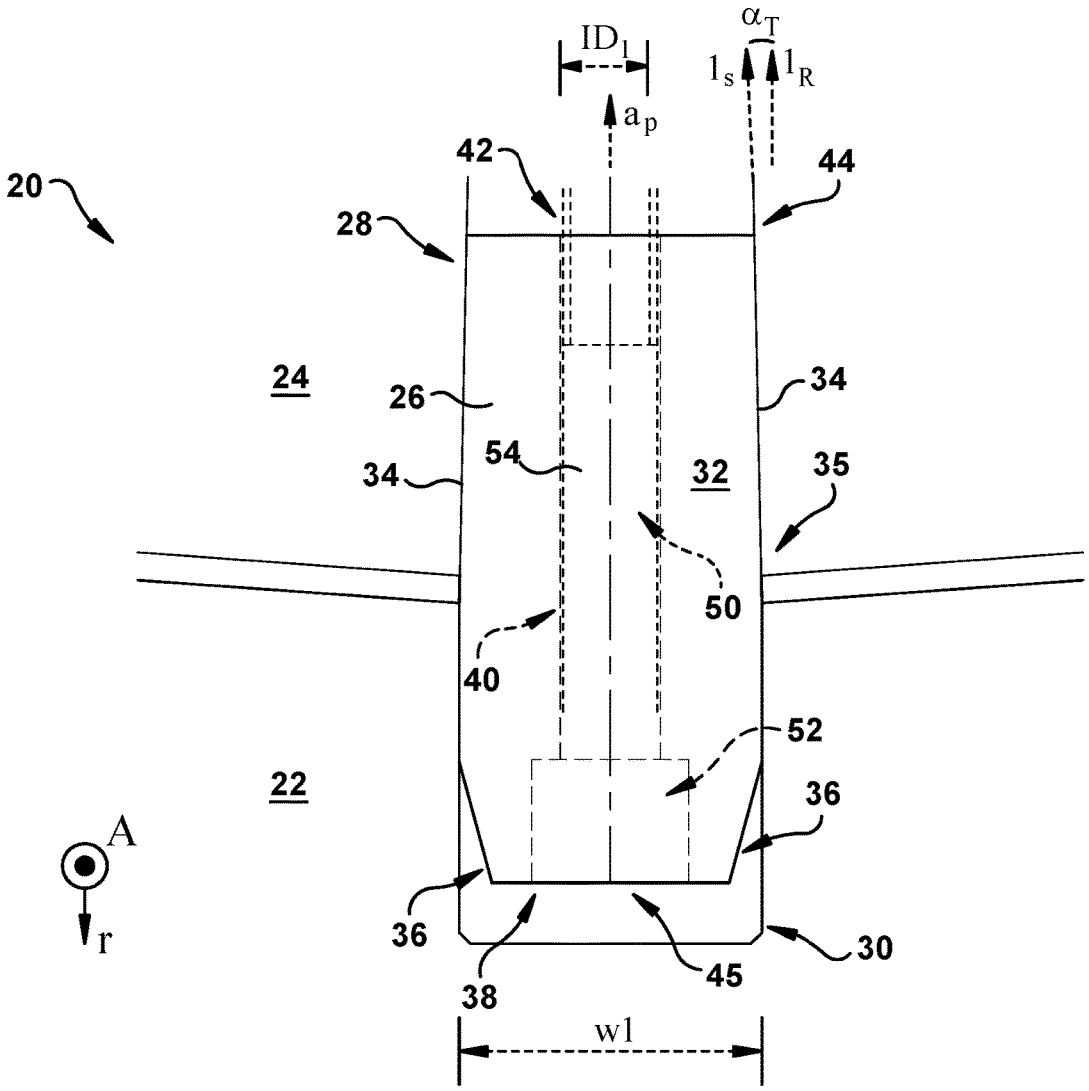
FIG. 3 shows a close-up side cross-sectional view of the portion of the turbomachine of FIG. 2.

FIG. 2 shows a partially transparent three-dimensional schematic depiction of a portion of a turbomachine 20 (e.g., steam turbine 2) according to various embodiments of the disclosure. FIG. 3 shows a close-up side cross-sectional view of the portion of turbomachine 20 (e.g., steam turbine 2). In particular, a section of casing 7 (casing segment 22) is shown at least partially housing a diaphragm segment 24, which can include a diaphragm segment from one of LP section 4, HP section 6 or another section of turbomachine 20. According to various embodiments, an alignment key 26 is shown for aligning diaphragm segment 24 with casing segment 22. In some cases, alignment key 26 is inserted into a diaphragm slot 28 in diaphragm segment 24, and subsequently positioned (e.g., inserted) into a casing slot 30 in casing segment 22. As shown in FIG. 3, alignment key 26 can include a body 32 having a primary axis ($a_p$), where body 32 is sided to engage diaphragm slot 28 in turbomachine 20. Body 32 can have sidewalls 34 extending along (e.g., in the general direction of) primary axis ($a_p$). Alignment key 26 can further include a chamfered tip section 36 continuous with body 32, e.g., proximate a first end 38 of body 32 along primary axis ($a_p$). Chamfered tip section 36 is sized to engage casing slot 30 in turbomachine 20. In various embodiments, alignment key 26 can include a slot 40 extending through body 32 and chamfered tip section 36, where slot 40 has a first opening 42 proximate a second end 44 of body 32 (along primary axis ($a_p$), opposite first end 38) and a second opening 45 proximate chamfered tip section 36. In various embodiments, sidewalls 34 of body 32 taper from second end 44 of body 32 toward chamfered tip section 36 (e.g., taper outward). That is, sidewalls 34 taper inward from a radially outer location (along axis (r), or along primary axis ($a_p$)) toward a radially inner location. The tapered sidewalls 34 are configured to permit insertion of alignment key 26 in diaphragm slot 28 without requiring cooling of alignment key 26 (e.g., exposed to below-freezing temperatures) as is the case with conventional alignment keys. In various embodiments, the taper on sidewalls 34 spans from approximately a point 35 measured along the length of sidewall 34 (measured along sidewall line, ($l_S$)) to the second end 44 of body 32. In various embodiments, point 35 is located proximate a midpoint (e.g., halfway along sidewall 34 measured between first end 38 and second end 44. In some cases, point 35 is closer to first end 38 than second end 44, as measured along sidewall line ($l_S$). In any case, the tapered sidewalls 34 would span a sufficient distance along the primary axis ($a_p$) such that body 32 is engaged with both casing segment 22 and diaphragm segment 24 to sustain a bending moment at high load.

Figure 4:
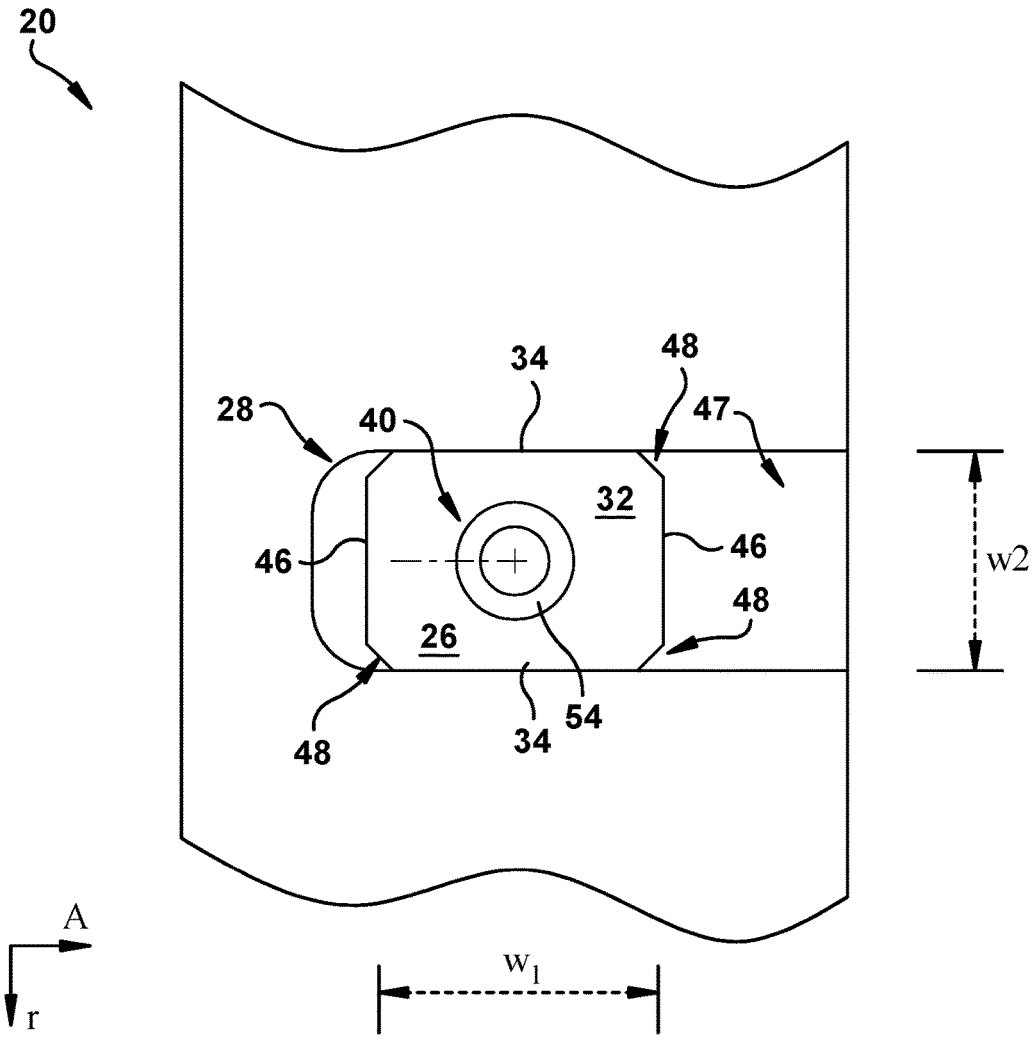
FIG. 4 shows a top cross-sectional view of the portion of turbomachine of FIG. 3.
Figure 5:
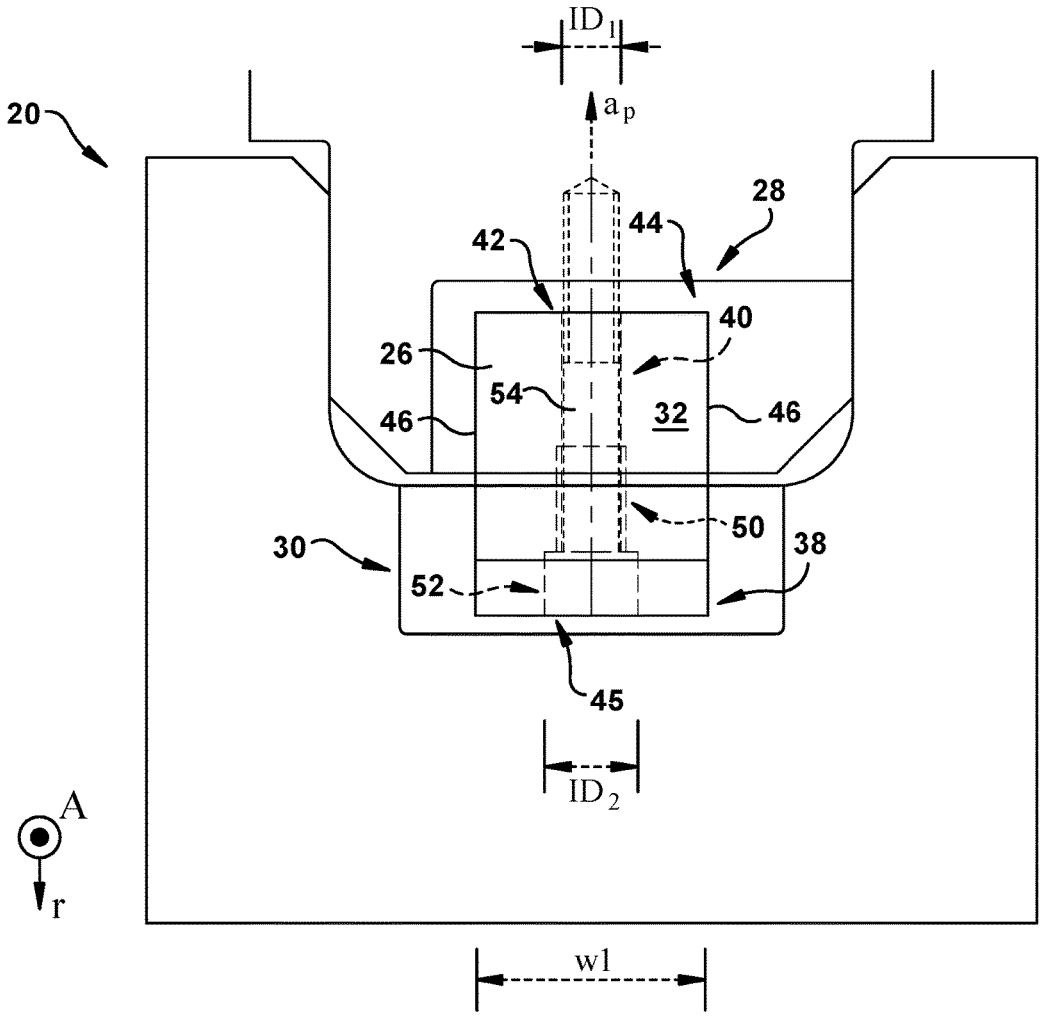
FIG. 5 shows a side cross-sectional view of a portion of a turbomachine according to various embodiments of the disclosure.

FIG. 4 shows a top cross-sectional view of the portion of turbomachine 20 of FIG. 3, illustrating that diaphragm slot 28 can include an axially extending portion 47, which allows for axial and radial loading/unloading of alignment key 26 into diaphragm slot 28. FIG. 5 shows a side cross-sectional view illustrating diaphragm slot 28 and casing slot 30 along the axial face of alignment key 26, further described herein.

With continuing reference to FIGS. 2-5, in various embodiments, alignment key 26 can include chamfered tip section 36 having an angle of approximately 10-15 degrees with respect to sidewalls 34. According to various embodiments, sidewalls 34 of body 32 taper at an angle ($\alpha_T$) of approximately one (1) to two (2) degrees with respect to a line perpendicular to the primary axis (e.g., reference line, $l_R$), illustrating using sidewall line ($l_S$). In various embodiments, sidewalls 34 include a first pair of opposing sidewalls extending along (generally) primary axis ($a_p$) (deviating from $a_p$ by taper angle). In various embodiments, as shown in FIGS. 4 and 5, body 32 can further include a second pair of opposing sidewalls 46, distinct from sidewalls 34 (e.g., first pair of opposing sidewalls). Second pair of opposing sidewalls 46, in various embodiments, can extend along primary axis ($a_p$), and are not tapered (e.g., are substantially parallel with primary axis ($a_p$).

In some cases, as shown in FIG. 4, body 32 can include at least one chamfered edge 48 between adjacent sidewalls (e.g., between sidewall 34 and adjacent one of second pair of opposing sidewalls 46. In various embodiments, as shown in FIGS. 2-4, the first pair of opposing sidewalls 34 has a greater width measured in a first direction ($w_1$) perpendicular to primary axis ($a_p$) than a width of the second pair of opposing sidewalls 46 measured in a second direction ($w_2$) perpendicular to primary axis ($a_p$), where the second direction ($w_2$) is perpendicular to the first direction ($w_1$).

FIGS. 3 and 5 illustrate various additional aspects of alignment key 26, for example, particular features of slot 40. In some cases, slot 40 includes a primary slot 50 extending from (second) end 44 of body 32 to chamfered tip section 36. Primary slot 50 can have a first internal dimension ($ID_1$), which in some embodiments, e.g., where slot 50 includes a substantially rounded aperture, is an inner diameter. Slot 40 can also include a secondary slot 52 fluidly connected with primary slot 50 and extending within chamfered tip section 36. Secondary slot 52 can have a second internal dimension ($ID_2$) (which can be an inner diameter where secondary slot 52 includes a substantially rounded aperture), which is greater than first internal dimension ($ID_1$). In various embodiments, slot 40 is sized to accommodate a retaining member 54, such as a screw, bolt, pin or other device capable of retaining alignment key 26 within diaphragm slot 28. In various embodiments, secondary slot 52 is sized to accommodate the head of retaining member 54, e.g., the head of a bolt, screw, pin or other retaining device (e.g., a countersink).

Figure 6:
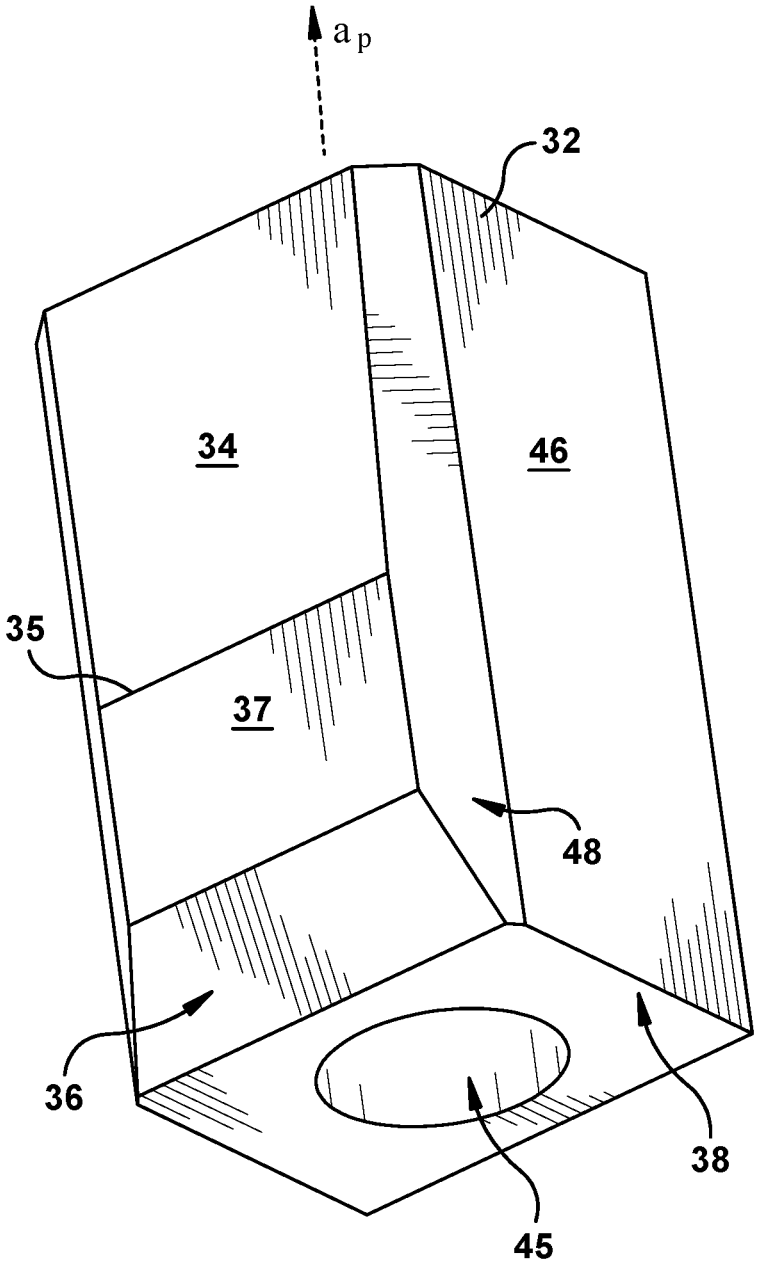
FIG. 6 shows a three-dimensional schematic depiction of a turbomachine alignment key according to various embodiments of the disclosure.
Figure 7:
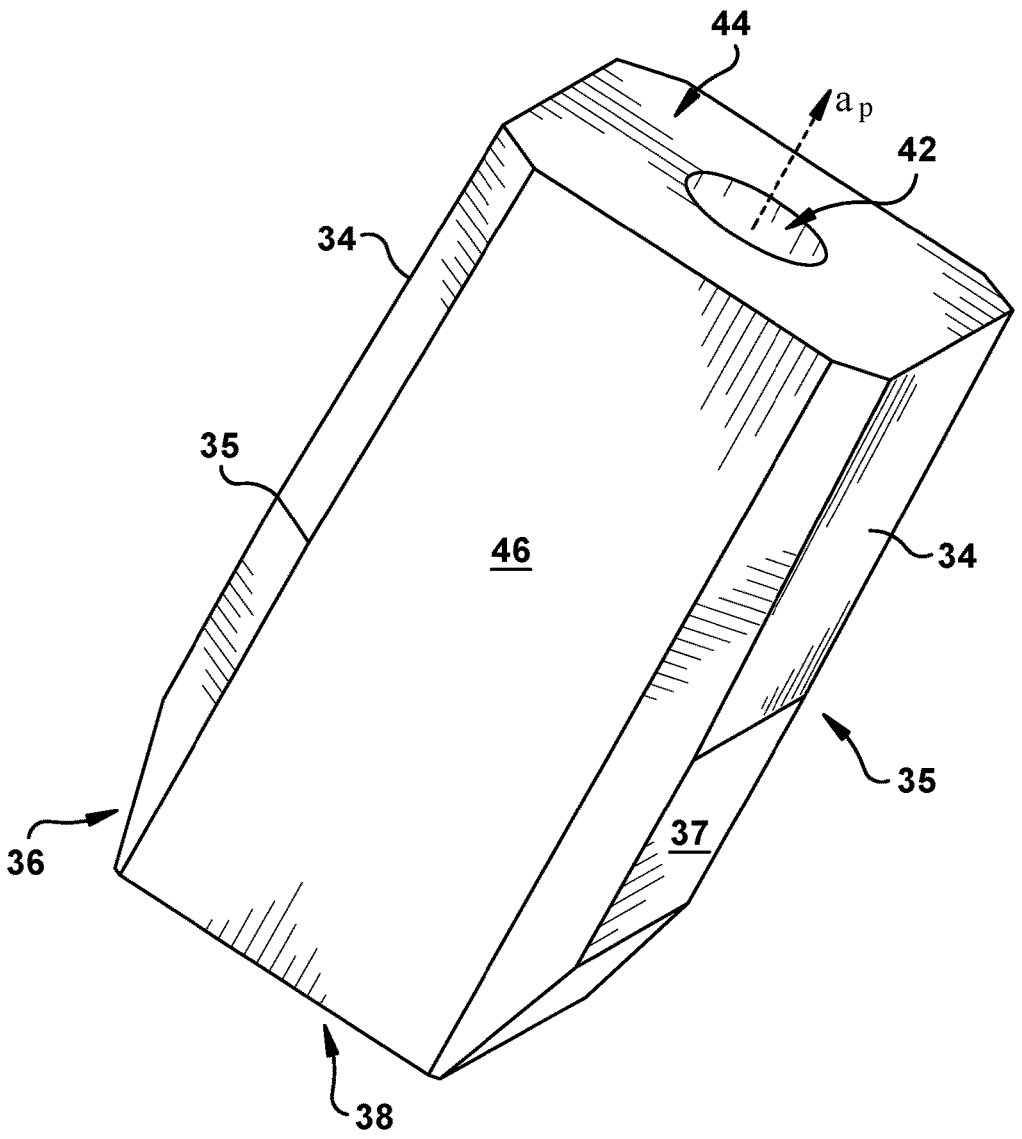
FIG. 7 shows a three-dimensional schematic depiction of the turbomachine alignment key of FIG. 6, from a distinct angle.

FIG. 6 shows a three-dimensional schematic depiction of alignment key 26 according to various embodiments, while FIG. 7 shows a three-dimensional schematic depiction of alignment key 26 of FIG. 6, from a distinct angle. As shown, according to various embodiments, sidewall 34 can include a substantially flat section 37 (e.g., parallel with primary axis $a_p$) which spans between the tapered section and chamfered tip section 36.

In any case, the alignment keys (and associated alignment apparatuses) shown and described herein allow for the alignment of a turbomachine casing and diaphragm while overcoming the various shortfalls of conventional pins (and apparatuses). The alignment keys (and associated alignment apparatuses) according to various embodiments of the invention have the technical effect of aligning a turbomachine apparatus in a controlled and progressive manner.

Alignment key 26 (FIGS. 2-7) may be formed in a number of ways. In one embodiment, alignment key 26 (FIGS. 2-7) may be formed by casting, forging, welding and/or machining. In one embodiment, however, additive manufacturing is particularly suited for manufacturing alignment key 26 (FIGS. 2-7). As used herein, additive manufacturing (AM) may include any process of producing an object through the successive layering of material rather than the removal of material, which is the case with conventional processes. Additive manufacturing can create complex geometries without the use of any sort of tools, molds or fixtures, and with little or no waste material. Instead of machining components from solid billets of plastic, much of which is cut away and discarded, the only material used in additive manufacturing is what is required to shape the part. Additive manufacturing processes may include but are not limited to: 3D printing, rapid prototyping (RP), direct digital manufacturing (DDM), selective laser melting (SLM) and direct metal laser melting (DMLM). In the current setting, DMLM has been found advantageous.

Figure 8:
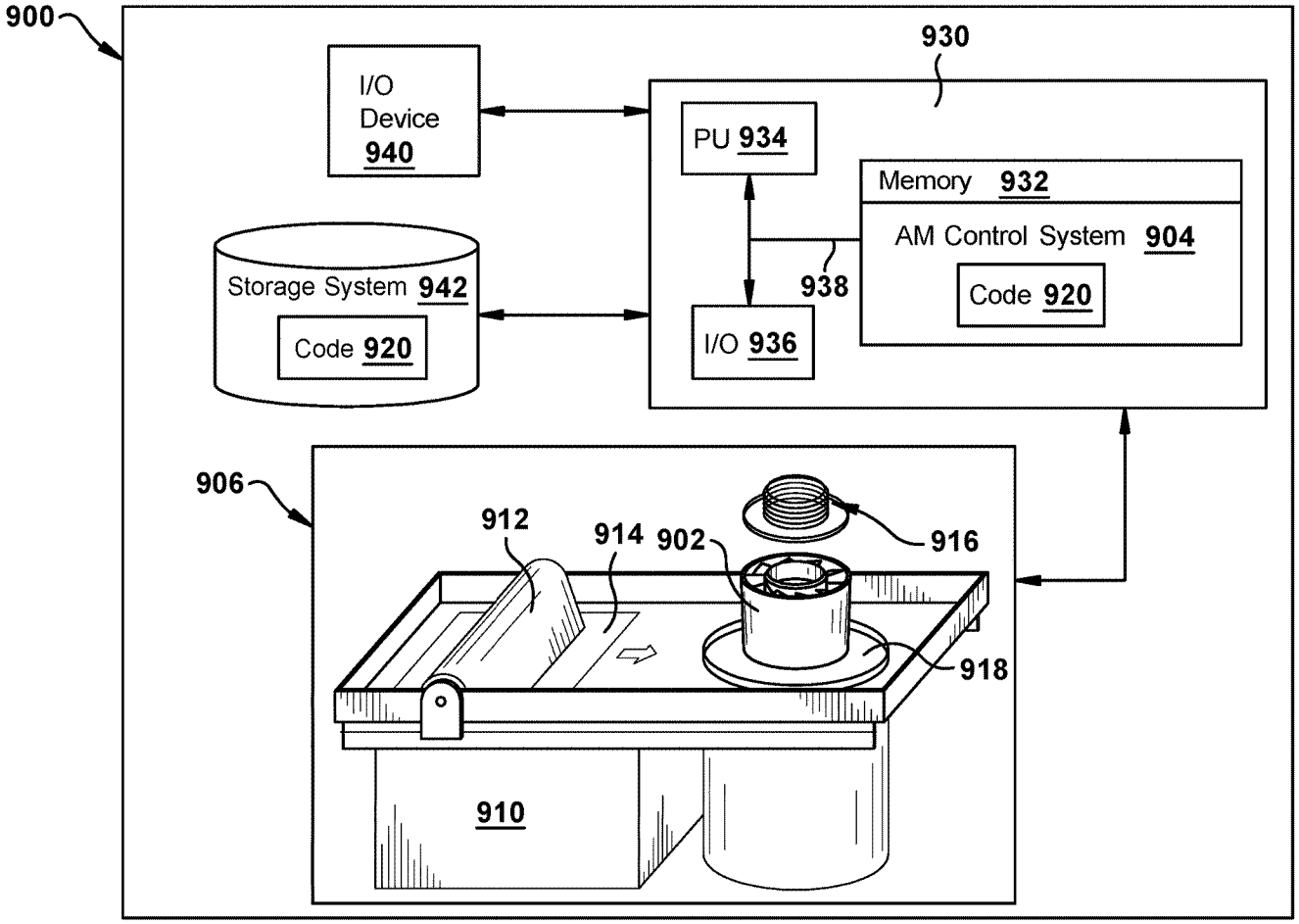
FIG. 8 shows a block diagram of an additive manufacturing process including a non-transitory computer readable storage medium storing code representative of a template according to embodiments of the disclosure.

To illustrate an example of an additive manufacturing process, FIG. 8 shows a schematic/block view of an illustrative computerized additive manufacturing system 900 for generating an object 902. In this example, system 900 is arranged for DMLM. It is understood that the general teachings of the disclosure are equally applicable to other forms of additive manufacturing. Object 902 is illustrated as a double walled turbine element; however, it is understood that the additive manufacturing process can be readily adapted to manufacture alignment key 26 (FIGS. 2-7). AM system 900 generally includes a computerized additive manufacturing (AM) control system 904 and an AM printer 906. AM system 900, as will be described, executes code 920 that includes a set of computer-executable instructions defining alignment key 26 (FIGS. 2-7) to physically generate the object using AM printer 906. Each AM process may use different raw materials in the form of, for example, fine-grain powder, liquid (e.g., polymers), sheet, etc., a stock of which may be held in a chamber 910 of AM printer 906. In the instant case, alignment key 26 (FIGS. 2-7) may be made of plastic/polymers or similar materials. As illustrated, an applicator 912 may create a thin layer of raw material 914 spread out as the blank canvas from which each successive slice of the final object will be created. In other cases, applicator 912 may directly apply or print the next layer onto a previous layer as defined by code 920, e.g., where the material is a polymer. In the example shown, a laser or electron beam 916 fuses particles for each slice, as defined by code 920, but this may not be necessary where a quick setting liquid plastic/polymer is employed. Various parts of AM printer 906 may move to accommodate the addition of each new layer, e.g., a build platform 918 may lower and/or chamber 910 and/or applicator 912 may rise after each layer.

AM control system 904 is shown implemented on computer 930 as computer program code. To this extent, computer 930 is shown including a memory 932, a processor 934, an input/output (I/O) interface 936, and a bus 938. Further, computer 930 is shown in communication with an external I/O device/resource 940 and a storage system 942. In general, processor 934 executes computer program code, such as AM control system 904, that is stored in memory 932 and/or storage system 942 under instructions from code 920 representative of alignment key 26 (FIGS. 2-7), described herein. While executing computer program code, processor 934 can read and/or write data to/from memory 932, storage system 942, I/O device 940 and/or AM printer 906. Bus 938 provides a communication link between each of the components in computer 930, and I/O device 940 can comprise any device that enables a user to interact with computer 940 (e.g., keyboard, pointing device, display, etc.). Computer 930 is only representative of various possible combinations of hardware and software. For example, processor 934 may comprise a single processing unit, or be distributed across one or more processing units in one or more locations, e.g., on a client and server. Similarly, memory 932 and/or storage system 942 may reside at one or more physical locations. Memory 932 and/or storage system 942 can comprise any combination of various types of non-transitory computer readable storage medium including magnetic media, optical media, random access memory (RAM), read only memory (ROM), etc. Computer 930 can comprise any type of computing device such as a network server, a desktop computer, a laptop, a handheld device, a mobile phone, a pager, a personal data assistant, etc.

Additive manufacturing processes begin with a non-transitory computer readable storage medium (e.g., memory 932, storage system 942, etc.) storing code 920 representative of alignment key 26 (FIGS. 2-7). As noted, code 920 includes a set of computer-executable instructions defining outer electrode that can be used to physically generate the tip, upon execution of the code by system 900. For example, code 920 may include a precisely defined 3D model of outer electrode and can be generated from any of a large variety of well-known computer aided design (CAD) software systems such as AutoCAD®, TurboCAD®, DesignCAD 3D Max, etc. In this regard, code 920 can take any now known or later developed file format. For example, code 920 may be in the Standard Tessellation Language (STL) which was created for stereolithography CAD programs of 3D Systems, or an additive manufacturing file (AMF), which is an American Society of Mechanical Engineers (ASME) standard that is an extensible markup-language (XML) based format designed to allow any CAD software to describe the shape and composition of any three-dimensional object to be fabricated on any AM printer. Code 920 may be translated between different formats, converted into a set of data signals and transmitted, received as a set of data signals and converted to code, stored, etc., as necessary. Code 920 may be an input to system 900 and may come from a part designer, an intellectual property (IP) provider, a design company, the operator or owner of system 900, or from other sources. In any event, AM control system 904 executes code 920, dividing alignment key 26 (FIGS. 2-7) into a series of thin slices that it assembles using AM printer 906 in successive layers of liquid, powder, sheet or other material. In the DMLM example, each layer is melted to the exact geometry defined by code 920 and fused to the preceding layer. Subsequently, the alignment key 26 (FIGS. 2-7) may be exposed to any variety of finishing processes, e.g., minor machining, sealing, polishing, assembly to other part of the igniter tip, etc.

In various embodiments, components described as being "coupled" to one another can be joined along one or more interfaces. In some embodiments, these interfaces can include junctions between distinct components, and in other cases, these interfaces can include a solidly and/or integrally formed interconnection. That is, in some cases, components that are "coupled" to one another can be simultaneously formed to define a single continuous member. However, in other embodiments, these coupled components can be formed as separate members and be subsequently joined through known processes (e.g., soldering, fastening, ultrasonic welding, bonding). In various embodiments, electronic components described as being "coupled" can be linked via conventional hard-wired and/or wireless means such that these electronic components can communicate data with one another.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An alignment key for a turbomachine, the alignment key comprising:

a body having a primary axis and sized to engage a diaphragm slot in the turbomachine, the body including:

a first end;

a second end positioned opposite the first end along the primary axis;

a first pair of opposing sidewalls extending along the primary axis, between the first end and the second end, the first pair of opposing sidewalls tapered from the second end toward the first end; and a second pair of opposing sidewalls distinct from the first pair of opposing sidewalls, the second pair of opposing sidewalls extending from the first end to the second end, and parallel to the primary axis;

a chamfered tip section continuous with the body and formed adjacent the first end, the chamfered tip section sized to engage a casing slot in the turbomachine; and an alignment key slot extending through the body and the chamfered tip section, the alignment key slot having a first opening proximate the second end of the body and a second opening proximate the chamfered tip section.

2. The alignment key of claim 1, wherein the chamfered tip section includes at least one chamfered edge having an angle of 10-15 degrees with respect to the sidewalls.

3. The alignment key of claim 1, wherein the first pair of opposing sidewalls of the body are tapered at an angle of 1-2 degrees with respect to a line perpendicular to the primary axis.

4. The alignment key of claim 1, wherein the body further includes at least one chamfered edge between adjacent sidewalls in the first pair of opposing sidewalls and the second pair of opposing sidewalls.

5. The alignment key of claim 1, wherein the first pair of opposing sidewalls has a greater width measured in a first direction perpendicular to the primary axis than a width of the second pair of opposing sidewalls measured in a second direction perpendicular to the primary axis, wherein the second direction is perpendicular to the first direction.

6. The alignment key of claim 1, wherein the alignment key slot includes:

a primary slot extending from the end of the body to the chamfered tip section, the primary slot having a first internal diameter; and a secondary slot fluidly connected with the primary slot and extending within the chamfered tip section, the secondary slot having a second internal diameter greater than the first internal diameter.

7. The alignment key of claim 1, wherein the body further includes a flat section extending between each of the first pair of opposing sidewalls and the chamfered tip section, the flat section formed parallel to the primary axis.

8. A turbomachine comprising:

a turbine diaphragm segment;

a turbine casing segment at least partially housing the turbine diaphragm segment; and an alignment key for aligning the turbine diaphragm segment with the turbine casing segment, the alignment key including:

a body having a primary axis and sized to engage a diaphragm slot in the turbomachine, the body including:

a first end;

a second end positioned opposite the first end along the primary axis;

a first pair of opposing sidewalls extending along the primary axis, between the first end and the second end, the first pair of opposing sidewalls tapered from the second end toward the first end; and a second pair of opposing sidewalls distinct from the first pair of opposing sidewalls, the second pair of opposing sidewalls extending from the first end to the second end, and parallel to the primary axis;

a chamfered tip section continuous with the body and formed adjacent the first end, the chamfered tip section sized to engage a casing slot in the turbomachine; and an alignment key slot extending through the body and the chamfered tip section, the alignment key slot having a first opening proximate the second end of the body and a second opening proximate the chamfered tip section.

9. The turbomachine of claim 8, wherein the chamfered tip section includes at least one chamfered edge having an angle of 10-15 degrees with respect to the sidewalls.

10. The turbomachine of claim 8, wherein the first pair of opposing sidewalls of the body are tapered at an angle of 1-2 degrees with respect to a line perpendicular to the primary axis.

11. The turbomachine of claim 8, wherein the body further includes at least one chamfered edge between adjacent sidewalls in the first pair of opposing sidewalls and the second pair of opposing sidewalls.

12. The turbomachine of claim 8, wherein the first pair of opposing sidewalls has a greater width measured in a first direction perpendicular to the primary axis than a width of the second pair of opposing sidewalls measured in a second direction perpendicular to the primary axis, wherein the second direction is perpendicular to the first direction.

13. The turbomachine of claim 8, wherein the alignment key slot includes:

a primary slot extending from the end of the body to the chamfered tip section, the primary slot having a first internal diameter; and a secondary slot fluidly connected with the primary slot and extending within the chamfered tip section, the secondary slot having a second internal diameter greater than the first internal diameter.

14. The turbomachine of claim 8, wherein the body of the alignment key further includes a flat section extending between each of the first pair of opposing sidewalls and the chamfered tip section, the flat section formed parallel to the primary axis.

15. A non-transitory computer readable storage medium storing code representative of an alignment key for a turbomachine, the alignment key physically generated upon execution of the code by a computerized additive manufacturing system, the code comprising:

code representing the alignment key, the alignment key including:

a body having a primary axis and sized to engage a diaphragm slot in the turbomachine, the body including:

a first end;

a second end positioned opposite the first end along the primary axis;

a first pair of opposing sidewalls extending along the primary axis, between the first end and the second end, the first pair of opposing sidewalls tapered from the second end toward the first end; and a second pair of opposing sidewalls distinct from the first pair of opposing sidewalls, the second pair of opposing sidewalls extending from the first end to the second end, and parallel to the primary axis;

a chamfered tip section continuous with the body and formed adjacent the first end, the chamfered tip section sized to engage a casing slot in the turbomachine; and an alignment key slot extending through the body and the chamfered tip section, the alignment key slot having a first opening proximate the second end of the body and a second opening proximate the chamfered tip section.

16. The storage medium of claim 15, wherein the chamfered tip section includes at least one chamfered edge having an angle of 10-15 degrees with respect to the sidewalls.

17. The storage medium of claim 15, wherein the first pair of opposing sidewalls of the body are tapered at an angle of 1 to 2 degrees with respect to a line perpendicular to the primary axis.

18. The storage medium of claim 15, wherein the body further includes at least one chamfered edge between adjacent sidewalls in the first pair of opposing sidewalls and the second pair of opposing sidewalls.

19. The storage medium of claim 15, wherein the body of the alignment key further includes a flat section extending between each of the first pair of opposing sidewalls and the chamfered tip section, the flat section formed parallel to the primary axis.

* * * * *